United States Patent [19]

Decker et al.

[11] 4,298,790

[45] Nov. 3, 1981

[54] METHOD OF AND APPARATUS FOR DETERMINING NUMBER OF SHEETS IN A STACK

[75] Inventors: Forrest W. Decker; Jacob R. Peternel, both of Pittsburgh, Pa.

[73] Assignee: PPG Industries, Inc., Pittsburgh, Pa.

[21] Appl. No.: 87,184

[22] Filed: Oct. 22, 1979

Related U.S. Application Data

[63] Continuation of Ser. No. 891,364, Mar. 29, 1978, abandoned.

[51] Int. Cl.[3] ..... G06M 9/00

[52] U.S. Cl. ..... 235/92 SB; 235/92 V

[58] Field of Search ..... 235/92 SB, 92 V, 92 PK, 235/92 DP, 98 R, 98 C; 364/468, 478

[56] References Cited

U.S. PATENT DOCUMENTS 3,813,523 5/1974 Mohan et al. ..... 235/92 SB 3,835,306 9/1974 Bills et al. ..... 235/92 SB

*Primary Examiner*—Joseph M. Thesz

*Attorney, Agent, or Firm*—Donald Carl Lepiane

[57] ABSTRACT

Reflected energy density signal as a function of distance in pulse counts determined from a side of stacked sheets is used to calculate sheet pulse counts. A working pulse range is determined from the nominal thickness range of the stacked sheets and thereafter pulse values within the working pulse range are selected. The calculated sheet pulse counts and selected pulse values are compared and acted on to develop a pair of sheet counts for each selected pulse value. The pair of sheet counts occurring at least 10 consecutive times is considered the number of sheets in the stack.

15 Claims, 6 Drawing Figures

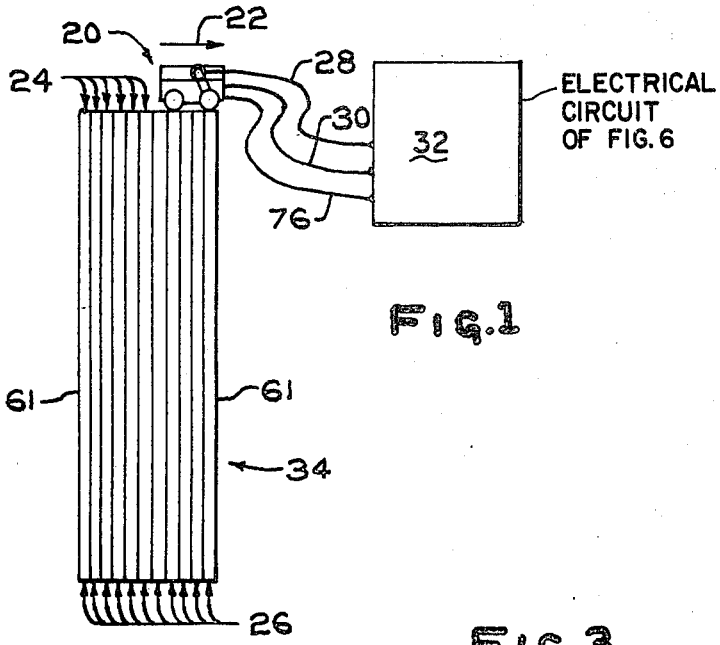
FIG. 1
FIG. 2
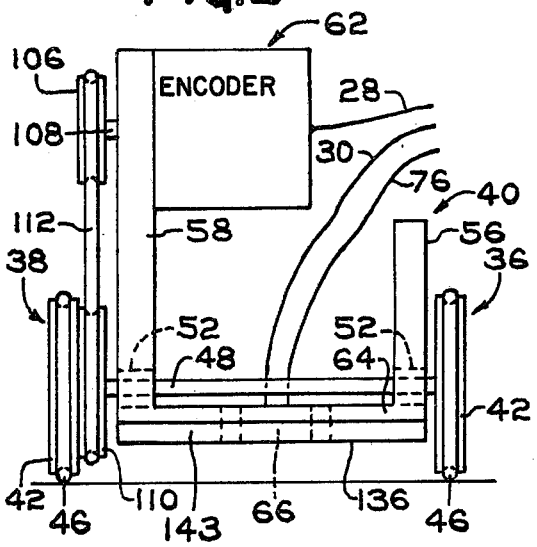
FIG. 3
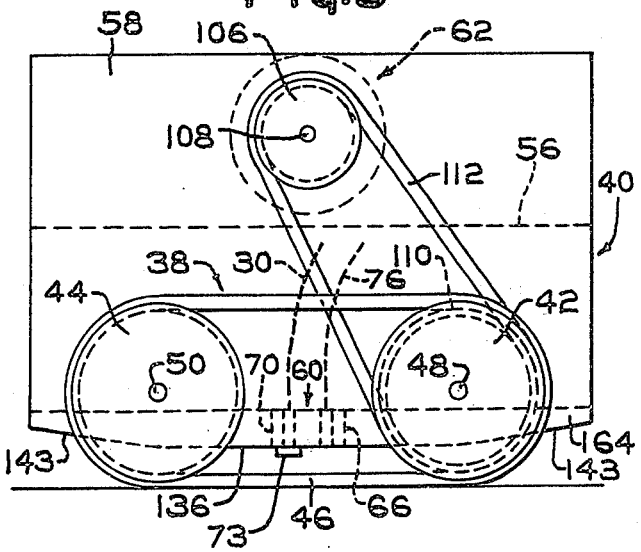
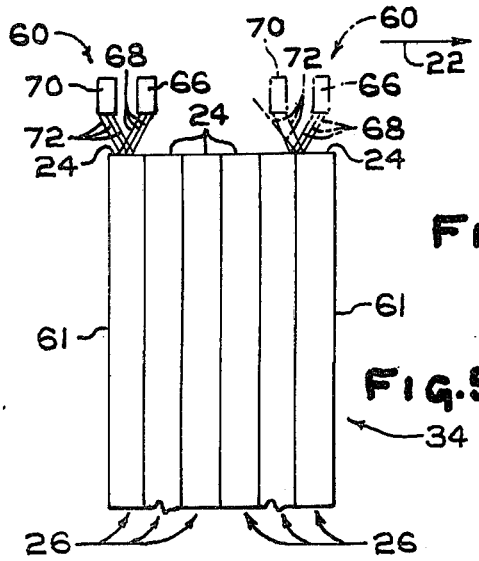
FIG. 4
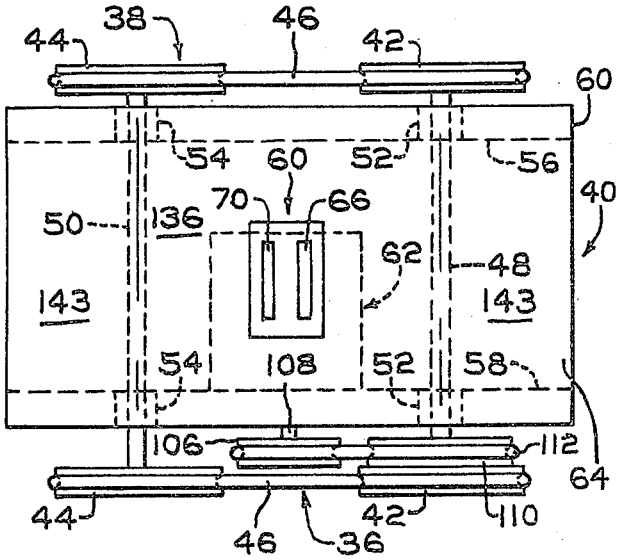
FIG. 5

METHOD OF AND APPARATUS FOR DETERMINING NUMBER OF SHEETS IN A STACK

This is continuation of application Ser. No. 891,364, filed Mar. 29, 1978, now abandoned.

BACKGROUND OF THE INVENTION

1. Field of the Invention

This invention relates to a method of and apparatus for determining the number of sheets, e.g., glass sheets in a stack.

2. Discussion of the Technical Problem and Prior Art

A predetermined number of glass sheets are loaded on racks and sent to fabricators. When the rack has more or less sheets than the predetermined number, the production planning schedules of the glass manufacture appears to be incorrect and may be erroneously revised.

Various techniques have been employed to determine the number of sheets on the rack but have been found to be unacceptable. For example, the racks have been weighed before loading and after loading to determine the weight of the sheets. Knowing the weight of one glass sheet, it would be thought that the number of sheets can be determined. However, since each glass sheet has a different thickness within the allowable glass thickness range, the weight of one sheet may not be and normally is not the weight of each sheet. Further, measuring peripheral dimensions and thickness or weighing the sheet to determine the number of stacked sheets is time consuming.

A technique commonly used is to count the number of stacked sheets during loading of the rack. Although this could be one of the most accurate techniques, it is not accurate because the packer has to count the sheets. Handling glass sheets requires the packer's undivided attention to avoid accidents. Concentration on handling the glass sheets causes sufficient distraction to result in inaccurate counting. Counting the sheets after they are loaded on the rack is another accurate technique; however, it is time consuming and adds to the cost of the sheets.

The prior art, e.g.,

| U.S. Pat. No. | U.S. Pat. No. |
|---|---|
| 3,220,569 | 3,743,820 |
| 3,312,888 | 3,790,759 |
| | 3,881,102 |
| 3,371,834 | 3,889,136 |
| 3,581,067 | 4,065,860 |
| 3,643,068 | RE 27,869 |
| 3,663,803 | |

teach apparatuses for or methods of counting sheets, e.g., paper sheets. The drawback in the prior art is that sheet thickness must be measured. As can be appreciated, measuring the sheet thickness is time consuming. Further, the apparatuses of the prior art are not portable and therefore the sheets are normally carried to the apparatus. Although this may be acceptable for paper sheets, it is not acceptable for glass sheets loaded on rack. This is because it is expensive to move racks loaded with glass sheets.

In U.S. patent application Ser. No. 891,365 now U.S. Pat. No. 4,232,218 filed even date in the names of F. W. Decker and H. Kenton for a "Plate Counter", there is taught a portable device for generating a reflective energy density signal and pulse counts indicating the position of the device on the stacked sheets. It would be advantageous to provide a method of and apparatus for acting on the information from the density signal and pulse counts to determine the number of sheets in the stack.

SUMMARY OF THE INVENTION

This invention relates to a method of determining the number of sheets in a stack, each sheet having an energy reflective side. The nominal thickness of the sheets is determined and the sheets are thereafter stacked with the energy reflective side of the sheets forming one side of the stack. A reflective energy density signal is generated from the energy reflective side of the stack. The signal shows energy density as a function of position on the stack in pulse counts. Calculated sheet pulse counts from the energy density signal and pulse counts; a working pulse range from the nominal thickness; as well as pulse count values within the working pulse range are determined. The calculated sheet pulse counts and each of the pulse count values are acted on to determine a pair of sheet counts for each pulse count value. The above procedures after the sheets are stacked are repeated when the number of consecutive pairs of equal sheet counts is less than a predetermined number. When the consecutive pair of equal sheet counts is equal to or greater than the predetermined number, the number of sheets in the stack is the sheet count in the consecutive pair of equal sheet counts.

The invention also relates to an apparatus for practicing the method.

BRIEF DESCRIPTION OF THE DRAWING

FIG. 1 is a schematic side view of a counter moving over a side of stacked glass sheets to generate a reflected energy density signal and pulse counts which are acted on in accordance to the teachings of the invention to determine the number of sheets in the stack;

FIG. 2 is an end view of the counter shown in FIG. 1;

FIG. 3 is a side view of the counter shown in FIG. 1;

FIG. 4 is a bottom view of the counter shown in FIG. 1;

FIG. 5 is an illustration of energy rays directed toward and reflected from the stacked sheets as the counter is displaced over the stacked sheets.

DESCRIPTION OF THE INVENTION

Figure 6:
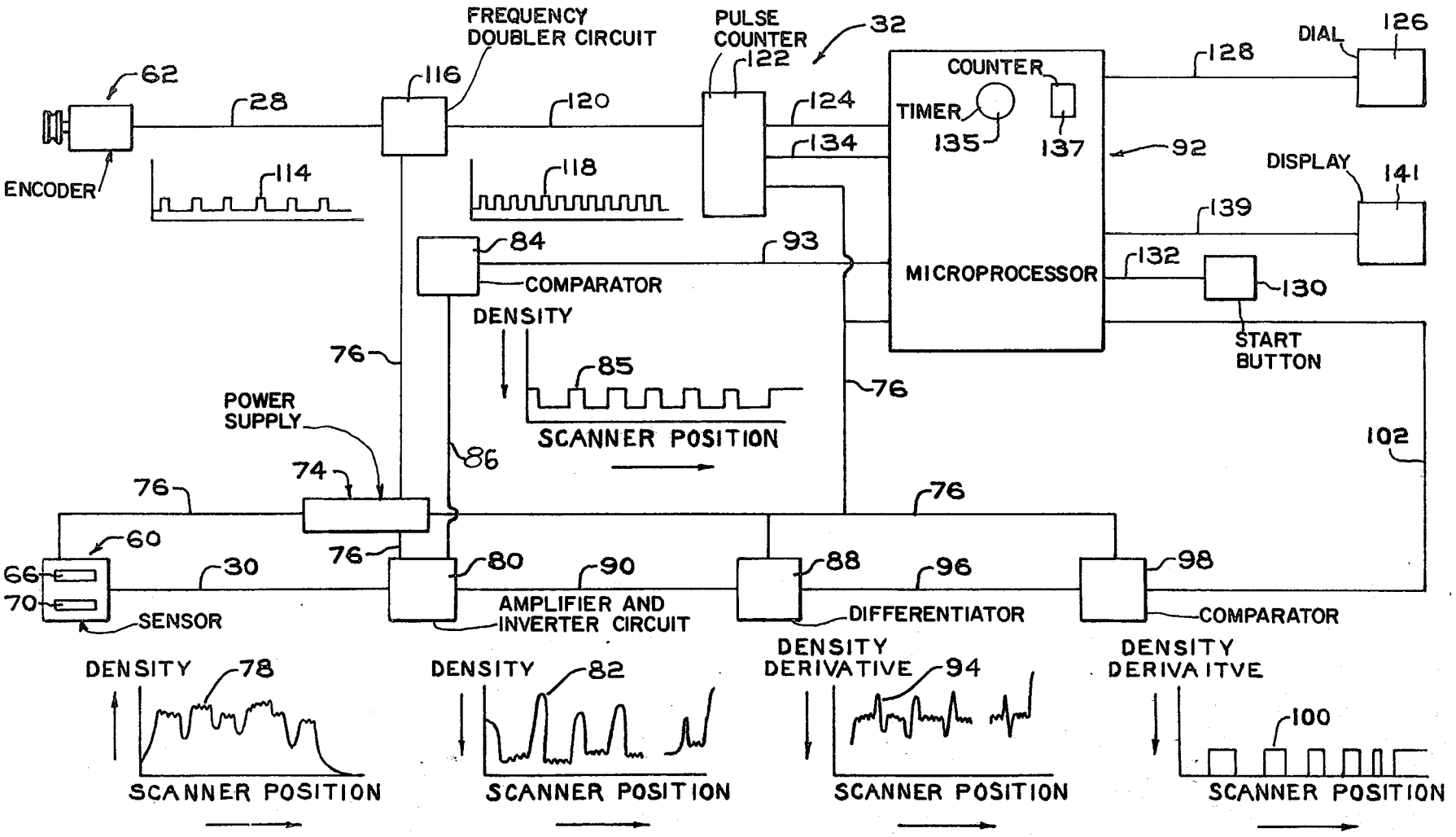
FIG. 6 is a block diagram of an electrical circuit and respective signals from electrical components of the circuit used in determining the number of stacked sheets.

FIG. 1 shows plate or sheet scanner 20 moving in the direction of arrow 22 on side 24 of stacked sheets 26 and forwarding signals by way of cables 28 and 30 to an electrical circuit 32 (shown in FIG. 6) to determine or count the number of sheets 26 in the stack 34. As will be appreciated, the construction of the sheet scanner 20 is not limiting to the invention and is present to illustrate types of scanners that may be used to generate a reflected energy density signal and pulse counts as a function of scanner travel which are acted on in accordance to the teachings of the invention in determining the number of sheets in the stack. In the following discussion, the invention will be discussed to determine the number of stacked glass sheets; however, as will be appreciated, the invention is not limited thereto. The plate scanner 20 to be discussed below is taught in U.S. patent application Ser. No. 891,365 filed even date in the names of F. W. Decker and H. Kenton for a "Plate Counter" which teachings are hereby incorporated by reference.

With reference to FIGS. 2-4, the scanner 20 has a pair of tracks 36 and 38 mounted about a U-shaped member 40. Each of the tracks 36 and 38 includes a pair of grooved wheels 42 and 44, respectively, for containing a rubber o-ring 46 as shown in FIGS. 3 and 4. The wheels 42 and 44 are each mounted on a shaft 48 and 50, respectively, which shafts 48 and 50 pass through bearings 52 and 54, respectively, pressed in side leg members 56 and 58 of the U-shaped member 40.

The scanner 20 includes (1) a sensor 60 for sensing the edge of the outermost stacked sheets 61 and the interface between adjacent sheets 26 and (2) an encoder 62 for monitoring wheel rotation as the scanner 20 is displaced on the sides 24 of the stacked sheets 26. The sensor 60 mounted in base 64 of the U-shaped member 40 includes a source or emitter 66 for directing light rays, e.g., infrared energy rays 68 (see FIG. 5), toward the sides 24 of the sheets 26 and a detector 70 for sensing the density of reflected infrared energy rays 72. The reflected rays 72 are at maximum density when reflected from a plane generally parallel to the surface of the emitter 66 and detector 70 and the density decreases when the rays 68 are incident on the edges of the outermost stacked sheets 61 and on the interface between adjacent stacked sheets. In the instance where infrared rays are employed, it is recommended that a filter 73 (shown only in FIG. 3) be mounted over the detector 70 to filter out visible light.

Sensors that may be used are known as reflective object sensors and are sold by Monsanto Company of Palo Alto, CA, Catalogue No. MCA 7. These sensors have a preset center-to-center spacing between the emitter 66 and detector 70. The sensor is set a predetermined distance from the sides of the stacked sheets by considering the distance between the sides of the stacked sheets and the base 64 of the U-shaped member 40 which may be determined from the diameter of the wheels 42 and 44 and the cross-sectional diameter of the belts 46.

Referring now to FIG. 6, the sensor 60 and electrical circuit 32 are connected to a power supply 74 by electrical wires. Signal 78 from the detector 70 shows (1) an increase in density of the reflected rays 72 as the sensor 60 moves over the edge of the first sensed outermost sheet; (2) variations in the density of the reflected rays 72 as the sensor 60 moves over sides of the staccked sheets; (3) a significant drop and thereafter an increase in the density of the reflected rays 72 as the sensor 60 moves over the interface between adjacent sheets; and (4) a significant drop and no subsequent increase in density of the reflected rays 72 as the sensor 60 moves over the outer edge of the last sensed outermost sheet 61. The variations in the signal 78 between sensed interfaces are due to the raw cut edge of the glass. If the raw cut glass edges are polished, the signal variations would be minimal if not eliminated. Further, the signal 78 from the detector 70 does not lie on a straight line because the edges of the stacked glass sheets do not lie in a flat plane. It should be noted that the presence or absence of a significant decrease followed by an increase in density of the reflected rays of the signal 78 does not positively indicate the presence or absence of an interface. This is because the adjacent sheets may be close together and the edges smooth. Therefore the density of the reflected rays from the interface may be of the same magnitude as the density of reflected rays from the cut glass edge.

the signal 78 from the detector 70 is forwarded by cable 30 to an amplifier and inverter circuit 80 of the type used in the art to amplify and invert the signal 78. The signal 78 from the detector 70 is amplified because it is too small to work on. The signal 78 is inverted to permit adjustment of the time constant of the sensor circuit while minimizing the effect on the signal level from the detector 70. Amplified and inverted signal 82 is forwarded to a comparator 84 through cable 86 and to a differentiator 88 through cable 90. The comparator 84 is set at a predetermined level to square the peaks of the signal 82 and forward the resulting signal 85 to microprocessor 92 by cable 93. The microprocessor 92 only considers the first trailing edge of the signal 85 which corresponds to sensed increase in density of the infrared energy rays reflected from the edge of the first outermost sheet and disregards the remaining portion of the signal 85 for reasons discussed below.

The differentiator 88 differentiates the signal 82 so that the deviation due to nonalignment of the sides 24 of the stacked glass sheets 26 is minimized and signal 94 from the differentiator 88 is forwarded by way of cable 96 to a comparator 98. The comparator 98 is set to square peaks of the signal 94 below a predetermined density level for use in the microprocessor 92 which requires a binary signal. Signal 100 from the comparator 98 is forwarded to the microprocessor 92 by way of cable 102. The signal 100 from the comparator 98 does not have a squared peak corresponding to the edge of the first outermost sheet because the density of the reflected rays 72 (FIG. 5) only increase as the scanner moves over the edge of the first outermost sheet whereas the density of the reflected rays 72 from the interface between adjacent sheets decrease and thereafter increase, and the reflected rays 72 from the last outermost sheet decreases. In order to sense the first outermost sheet or the start of the scanning cycle, the signal 82 from the inverter and amplifier circuit 80 is forwarded to the comparator 84.

Referring back to FIGS. 2 and 3, the encoder 62 is mounted on the leg 58 of the U-shaped member 40. A peripherally grooved wheel 106 is mounted on shaft 108 of the encoder 62 and is operatively connected to peripherally grooved wheel 110 mounted on a shaft, e.g., the shaft 48, as shown in FIG. 2 by way of endless belt 112, e.g., a rubber o-ring. The encoder 62 recommended for use in the practice of the invention is of the type that generates a signal as its shaft 108 is rotated by the tracks 36 and 38. In this manner, the displacement of the scanner 20 along the sides 24 of the stacked sheets 26 is determined from the output signal of the encoder 62.

Referring back to FIG. 6, signal 114 from the encoder 62 is forwarded by way of the cable 28 to a frequency doubler circuit 116 for better resolution. Signal 118 from the doubler circuit 116 is forwarded by way of cable 120 to pulse counter 122 which forwards pulse counts on command to the microprocessor 92 by way of cable 124. The microprocessor operates on the pulse counts from the pulse counter 122 and on signals 85 and 100 from the comparators 84 and 98, respectively, in accordance to the teachings of the invention as discussed below, to determine or count the number of sheets 26 in the stack 34.

The thickness of selected sheets to be stacked is measured using a commerically available micrometer to provide a nominal glass thickness. The stacked glass sheets 26 each have a thickness within a given thickness range which is designated by the nominal glass thickness. For example, 0.250 inch (0.635 centimeters) nominally thick glass includes glass in the thickness range of 0.250±0.015 inch (0.635±0.038 centimeters) and 0.100 inch (0.254 centimeters) nominally thick glass includes glass in the thickness range of 0.100±0.007 inches (0.254±0.0178 centimeters). The nominal glass thickness for the stacked sheets is set on dial 126 connected to the microprocessor 92 by cable 128.

Start button 130 connected to the microprocessor 92 by cable 132 initiates the microprocessor 92 to receive the nominal glass thickness signal from the dial 126. The microprocessor 92 is programmed to select a working thickness range, for each nominal glass thickness. The working thickness range is greater than the given thickness range to consider those situations where the glass thickness of the sheets are crowded near the limit of the given thickness range. The microprocessor 92 thereafter converts the upper limit of the working thickness range to an upper limit pulse count; the lower limit of the working thickness range to a lower limit pulse count; subtracts the lower limit pulse count from the upper limit pulse count and divides the difference into incremental pulse intervals to be acted on. By way of illustration, the dial is set at 250 which corresponds to a nominal glass thickness of 0.250 inches (0.635 centimeters) and the given thickness range of the stacked sheets is 0.250±0.015 inch (0.635±0.038 centimeters). The microprocessor 92 expands the given thickness range to a working pulse range of 362 pulses to 502 pulses which corresponds to a working thickness range of 0.203 inches (0.597 centimeters) to 0.282 inches (0.673 centimeters). The working pulse range for glass thickness was determined empirically by using the instant invention to count stacked sheets of different glass thicknesses and determine the limits which bound the manual count. The upper limit pulse count of the working pulse range is found to satisfy Equation 1 and the lower limit pulse count of the working pulse range is found to satisfy Equation 2:

$$U.C. = \frac{[NGT]\,[PF]\,[3065 - (NGT)\,(PF)]}{2320} \quad (1)$$

where

U.C. is the upper limit pulse limit;

NGT is the nominal glass thickness in inches; and

PF is a pulse factor.

$$L.C. = \frac{[NGT]\,[PF]\,[2961 - (NGT)\,(PF)]}{3081} \quad (2)$$

where

L.C. is the lower limit pulse limit; and

NGT and PF are as previously defined.

The pulse factor (P.F.) is a ratio of pulses to inches of the plate scanner travel determined in any conventional manner. For example, the pulse counter constructed, as discussed below, has 178 pulses for each 0.100 inch (0.254 centimeters) of scanner travel, i.e., 1780 pulses per inch (4521.2 pulses per centimeter). The pulse factor (P.F.) is used because (1) the microprocessor operates on pulse counts from the counter 122 and (2) a one-to-one ratio of pulses to inches is not normally maintained due to the characteristics of the encoder and construction of the scanner. It should further be noted that using a pulse factor (P.F.) of 1790 pulses per inch and a nominal glass thickness [NGT] of 0.250 inch of our example in Equation 1 gives an upper limit pulse count (U.L.) of 502.54 which is truncated in the microprocessor to give a value of 502, and Equation 2 gives a lower limit pulse count (L.C.) of 363.4 pulses which is truncated in the microprocessor to 362.

As is discussed below, pulse values separated by equal pulse counts within the working pulse range are operated on and the manner of selection of the pulse value is not limiting to the invention. It has been found that 31 equally spaced pulse counts within the working pulse range are acceptable. The 31 pulse values are determined by subtracting the truncated lower pulse limit from the truncated upper pulse limit as determined by Equations 1 and 2, respectively, and dividing the difference by 30.

In practice, the scanner 20 is displaced over the sides 24 of the stacked sheets 26 and signal 78 from the detector 70 of the sensor 60 is forwarded to the microprocessor 92, and the pulses from the encoder 62 are forwarded to the pulse counter 122 and thereafter to the microprocessor 92 as previously discussed. The microprocessor 92, upon receiving the first trailing edge of the signal 85, (1) disregards the remaining portions of the signal 85; (2) resets the pulse counter 122 to zero by a signal sent through cable 134; (3) resets timer 135, e.g., a software timing program, in the microprocessor 92 to zero; and (4) resets sheet counter 137 in the microprocessor 92 to zero. The pulses of the signal 118 are counted in the pulse counter 122 until either the timer 135 times out or the leading edge of the first square peak of the signal 100 from the comparator 98 is received. The timer 135 is set not to time out for a time period in which the scanner is expected to be displaced over a predetermined length of the stacked sheets. It has been found that setting the timer 135 to time out after 1 second, in which time approximately 5 inches of the stacked sheets are expected to be scanned, several square peaks of the signal 100 are forwarded to the microprocessor 92.

When the leading edge of the first peak of the signal 100 is received by the microprocessor 92, (1) the pulse count in the counter 122 is forwarded through the cable 124 to the microprocessor 92; (2) the pulse count is stored in the microprocessor 92 as a first measured sheet pulse count; (3) a signal from the microprocessor 92 is forwarded through the cable 134 to reset the pulse counter 122 to zero; and (4) the timer 135 is reset to zero. The pulse counter 122 resumes counting until the trailing edge of the first squared peak is sensed by the microprocessor 92 at which time (1) the pulse count from the pulse counter 122 is received by the microprocessor 92; (2) the pulse count is stored in the microprocessor 92 as a first measured interface pulse count; and (3) the pulse counter 122 and timer 135 are reset to zero as previously discussed. The pulse counter 122 resumes counting until the leading edge of the second squared peak of the signal 100 is sensed by the microprocessor at which time (1) the counts from the pulse counter are received by the microprocessor 92; (2) the pulse counts are stored in the microprocessor as second measured sheet pulse count; and (3) the pulse counter 122 and timer 135 are reset to zero as previously discussed. The above is repeated to determine the remaining measured interface pulse counts and measured sheet pulse counts.

After the leading edge of the last squared peak which represents the edge of the last outermost sheet is sensed, the timer 135 times out because there are no remaining squared peaks and the pulse count in the pulse counter 122 is disregarded and collection of data is terminated.

The program in the microprocessor 92 acts on the measured sheet pulse counts and measured interfaced pulse counts to determine a calculated sheet pulse count for each measured sheet pulse count by adding the measured sheet pulse count to one-half the adjacent measured interface pulse count. For example, the first calculated sheet pulse count is the first measured sheet pulse count added to one-half the first measured interface pulse count; the second calculated sheet pulse count is the sum of the second measured sheet pulse count; one-half the first measured interface pulse count; and one-half the second measured interface pulse count; the third calculated sheet pulse count is the sum of the third measured sheet pulse count; one-half the second measured interface pulse count and one-half the third measured interface pulse count. The remaining calculated sheet pulse counts except for the last calculated sheet pulse count are determined in a similar manner. The last calculated sheet pulse count is the sum of the last measured sheet pulse count and one-half the last measured interface pulse count.

The microprocessor thereafter individually acts on each of the 31 pulse values of the working pulse range as follows.

Section I

A pulse value is selected and added to zero to determine a first tentative, first adjusted pulse value after which a one is added to the sheet counter 137 in the microprocessor 92. The first calculated sheet pulse count is added to zero to determine a first tentative, first adjusted sheet pulse count. The first tentative, first adjusted pulse value is subtracted from the first tentative, first adjusted sheet pulse count to determine a first tentative, first sheet pulse difference. If the absolute value of the first tentative, first sheet pulse difference is less than one-half the selected pulse value, the procedure of Section II is followed. If the first tentative, first sheet pulse difference is negative and the absolute value greater than one-half the selected pulse value, the procedure in Section III is followed. If the first tentative, first sheet pulse difference is positive and the absolute value greater than one-half the selected pulse value, the procedure in Part IV, is followed.

Section II

This section is practiced when the absolute value of the tentative sheet pulse difference is less than one-half the selected pulse value. The first tentative, first adjusted pulse value becomes the first adjusted pulse value; the first tentative, first adjusted sheet pulse count becomes the first adjusted sheet pulse count and the first tentative, first sheet pulse difference becomes the first sheet pulse difference. A sheet adjustment factor (M) is determined from Equation 3:

$$M_x = \frac{D_x + 6M_{x-1}}{8} \quad (3)$$

where $M_{x-1}$ is the previous adjustment factor with $M_o=0$; and $D_x$ is the sheet pulse difference.

The first sheet adjustment factor ($M_1$) is added to the selected pulse value to determine a first modified pulse value. The first modified pulse value is added to the first adjusted pulse value to determine a first tentative, second adjusted pulse value and a one is added to the sheet counter 137. The first adjusted sheet pulse count added to the next available calculated sheet pulse count to determine a first tentative, second adjusted sheet pulse count. The first tentative, second adjusted sheet pulse value is subtracted from the first tentative, second adjusted sheet pulse count to determine a first tentative, second sheet pulse difference. If the absolute value of the first tentative, second sheet pulse difference is less than one-half the selected pulse value, the preceding steps of Section II are repeated. For example, the first tentative, second adjusted sheet pulse count becomes the second adjusted sheet pulse count; the first tentative, second adjusted pulse value becomes the second adjusted pulse value; and the first tentative, second sheet pulse difference becomes the second sheet pulse difference. A second sheet adjustment factor ($M_2$) is determined from Equation 3 by adding the second sheet pulse difference to 6 times the first adjustment factor ($M_1$) and dividing the sum by 8. The second sheet adjustment factor is added to the selected pulse value to determine a second modified pulse value which is added to the second adjusted pulse value to give a first tentative, third adjusted pulse value and a one is added to the sheet counter 137 in the microprocessor. The second adjusted sheet pulse count is added to the next available calculated sheet pulse count to determine a first tentative, third adjusted sheet pulse count. The first tentative, third adjusted pulse value is subtracted from the first tentative, third adjusted sheet pulse count to give a first tentative, third sheet pulse difference. If the absolute value of the first tentative, thrid sheet pulse difference is less than one-half the selected pulse value, the first tentative, third adjusted pulse value becomes the third adjusted pulse value; the first tentative, third adjusted sheet pulse count becomes the third adjusted sheet pulse count; and the first tentative third sheet pulse difference becomes the third sheet pulse difference, etc.

The above is repeated until there are no remaining calculated sheet pulse values at which time the count in the counter 137 is stored along with the selected pulse value for which the sheet count was determined.

If the tentative sheet pulse difference is negative and the absolute value greater than one-half the selected pulse value, the procedure of Section III is followed. If the tentative sheet pulse difference is positive and the absolute value greater than one-half the selected pulse value, the procedure of Part II, Section IV is followed.

Section III

This section is practiced when the tentative sheet pulse difference is negative and the absolute value greater than one-half the selected pulse value indicating that the tentative adjusted pulse value is greater than the tentative adjusted sheet pulse count.

The next available calculated sheet pulse count is added to the tentative adjusted sheet pulse count to determine a new tentative, adjusted sheet pulse count. The first tentative adjusted sheet pulse value is substracted from the new tentative, adjusted pulse count to determine a new tentative, sheet pulse difference. If the new tentative sheet pulse difference is negative and the absolute value is greater than one-half the selected pulse value, the procedure outlined in this Section III is followed. For example, it has been determined that the first tentative sheet pulse difference is negative and the absolute value greater than one-half the selected pulse value. The next available calculated sheet pulse count is added to the first tentative, first adjusted sheet pulse count to determine a second tentative, first adjusted sheet pulse count. The first tentative, first adjusted pulse value is substracted from the second tentative, first sheet pulse count to determine a second tentative, first sheet pulse difference. If the second tentative, first sheet pulse difference is negative and the absolute value greater than one-half the selected pulse value, a third tentative, first adjusted sheet pulse count is determined by adding the next available calculated sheet pulse count to the second tentative, first adjusted sheet pulse count and the above steps repeated.

If (1) the tentative sheet pulse difference is negative and (2) the absolute value is greater than one-half the selected pulse value and there are no remaining calculated sheet pulse counts, a one is subtracted from the sheet counter 137 and the sheet count is stored along with the selected pulse value for which the sheet count was determined.

If the absolute value of the tentative sheet pulse difference is less than one-half the selected pulse value, the procedure in Section II is practiced. If the tentative first sheet pulse difference is positive and the absolute value greater than one-half the selected pulse value, the procedure in Part I, Section IV, is practiced. If the tentative sheet pulse difference other than the tentative first sheet pulse difference is positive and the absolute value greater than one-half the selected pulse value, the procedure in Part II, Section IV, is practiced.

Section IV

Part I

This section is practiced when the tentative, first sheet pulse difference is positive and the absolute value is greater than one-half the selected pulse value indicating that the tentative, first adjusted sheet pulse count is greater than the tentative, first adjusted pulse value.

For example, consider that the tentative, first sheet pulse difference is the first tentative, first sheet pulse difference, and this Part of Section IV is applicable. The first tentative, first adjusted pulse value is added to the selected pulse value to determine a second tentative, first adjusted pulse value and a one is added to the sheet counter. The second tentative, first adjusted pulse value is subtracted from the first tentative, first adjusted sheet pulse count to determine a second tentative, first sheet pulse difference. If the second tentative, first sheet pulse difference is positive and the absolute value is greater than one-half the selected pulse value, the second tentative, first adjusted pulse value is added to the selected pulse value to determine a third tentative, first adjusted pulse value and a one added to the counter. A third and subsequent tentative, first sheet pulse differences are determined as previously discussed if the third and subsequent, first sheet pulse differences are positive and the absolute value greater than one-half the selected pulse value.

When the absolute value of the tentative, first sheet pulse difference is less than one-half the selected pulse value, the procedure of Section II is followed. When the tentative, first sheet pulse difference is negative and the absolute value greater than one-half the selected pulse value, the procedure of Section III is followed.

Part II

This section is practiced when the tentative sheet pulse differences other than the tentative first sheet pulse difference is negative and the absolute value greater than one-half the selected pulse value. The modified pulse value is added to the tentative adjusted pulse value to determine a new tentative adjusted pulse value and a one is added to the counter 137. For example, assume that the first tentative, third sheet pulse difference is positive and the absolute value greater than one-half the selected pulse value. The second modified pulse value is added to the first tentative, third adjusted pulse value to determine a second tentative, third adjusted pulse value and a one is added to the counter 137. A second tentative, third sheet pulse difference is determined by subtracting the second tentative, third adjusted pulse value from the tentative, third adjusted sheet pulse count. If the second tentative, third sheet pulse difference is positive and the absolute value greater than one-half the selected pulse value, the above procedure of Part II, Section IV, is practiced.

If the absolute value of the tentative, sheet pulse difference is less than one-half the selected pulse value, the procedure of Section II is followed. If the sheet pulse difference is negative and the absolute value greater than one-half the selected pulse value, the procedure of Section III is followed.

Sections I through IV are repeated for each pulse value within the working pulse range in the order in which the calculated sheet pulse counts were determined and then in the reverse order. Sheet counts of equal value for selected pulse values are considered to be a pair and stored. The number of sheets in the stack is the greatest number of consecutive pairs and at least 10 consecutive pairs. If the same number of at least 10 consecutive pairs are found, which rarely if ever occurs, the invention is not limiting to the one selected because each number would be of minimal error as to the sheet count. The sheet number is forwarded by cable 139 to output display 141. If there are less than 10 consecutive pairs, a special count outside the range of possible counts appears on the output display indicating that the scanning operation and subsequent calculations should be repeated.

DETAILED DESCRIPTION OF THE INVENTION

Plate counter 20 and circuit 32 are used to count 10 stacked glass sheets 26 in accordance to the teachings of the invention. Each of the glass sheets are about 4 inches (10.16 centimeters) square and have a nominal glass thickness of 0.250 inches (0.635 centimeters). With reference to FIGS. 2–4, the plate counter 20 has a pair of tracks 36 and 38 mounted about an aluminum U-shaped member 40. The U-shaped member 40 has a cross-sectional thickness of about $\frac{1}{4}$ inch (0.635 centimeters), a leg 58 having a height of about 2 inches (5.08 centimeters), a leg 56 having a height of about $\frac{3}{4}$ inch (1.905 centimeters) and each having a length of $2\frac{1}{4}$ inches (5.715 centimeters), and a base 64 having a length of about $2\frac{1}{4}$ inches (5.715 centimeters) and a width of about $1\frac{5}{8}$ inches (4.128 centimeters). Outer surface 136 of the base 64 has 7° tapered ends 143 to provide clearance as the plate counter 20 moves over outermost sheets 61 of the stack 34.

Tracks 36 and 38 each include a pair of grooves wheels 42 and 44 having a thickness of about $\frac{1}{4}$ inch (0.635 centimeters), a diameter of about $\frac{7}{8}$ inch (2.223 centimeters) and a peripheral groove having a radius of about 0.062 inch (0.157 centimeters). The wheels 42 and 44 of the tracks 36 and 38 are mounted on a shaft 48 and 50, respectively, having a diameter of about 0.188 inch (0.478 centimeters), and a length of about $2\frac{5}{8}$ inches (6.668 centimeters). The shafts 48 and 50 are mounted on a center-to-center spacing of about 1 inch (2.54 centimeters) and spaced about $\frac{3}{8}$ inch (0.953 centimeters) from the outer surface 136 of the base 64 of the U-shaped member 40. An o-ring 46 having a diameter of about $1\frac{5}{8}$ inches (4.128 centimeters) and a cross-sectional diameter of about 0.124 inch (0.315 centimeters) is mounted in the peripheral grooves of the wheels 42 and 44 of the tracks 36 and 38.

A sensor 60 of the type sold by Monsanto Company of Palo Alto, Cal., Catalogue No. MCA 7, is mounted in the center of the base 64 of the U-shaped member 40 spaced about 1/16 inch (0.159 centimeters) from the plane subtended by the tracks 36 and 38 as the counter moves over the sides 24 of the stacked sheets 26. Emitter 66 and the detector 70 of the sensor 60 are connected by cable 76 to power supply 74 (see FIG. 6). A visible light filter 73 of the type known in the art to pass predominantly infrared energy rays is mounted over the detector 70.

An encoder 62 of the type sold by Teledyne Corporation of Troy, N.Y., Model 8610, is mounted on the leg 58 of the U-shaped member 40 as shown in FIG. 2. A grooved wheel 106 having a thickness of about 0.344 inch (0.874 centimeters), a diameter of about 0.375 inch (0.953 centimeters) and a peripheral groove having a radius of about 0.031 inch (0.079 centimeters) is mounted on encoder shaft 108. A grooved wheel 110 having a diameter of about $\frac{7}{8}$ inch (2.223 centimeters), a thickness of about $\frac{1}{4}$ inch (0.635 centimeters) and a peripheral groove of about 0.062 inch (0.158 centimeters) is secured to the shaft 48 adjacent to wheel 42 of track 37. A rubber o-ring having a diameter of about $1\frac{5}{8}$ inches (4.128 centimeters) and a cross-sectional diameter of about 0.062 inch (0.157 centimeters) is mounted in the peripheral groove of the wheels 106 and 110.

As shown in FIG. 6, output signal 114 of the encoder 62 is forwarded to a frequency doubler circuit 116 by way of cable 28. The output signal of the detector 70 of the sensor 60 is forwarded to an amplifier and inverted circuit 80. The components of the electronic circuit 32 to be discussed below are powered by the power supply 74.

With reference to FIG. 5, as the plate counter 20 is displaced over the side 24 of the stacked sheets, the infrared energy rays 68 from the emitter 66 are directed toward the sides 24 of the stacked sheets and reflected toward the detector 70 of the sensor 60 as the encoder generates the signal 114 (see FIG. 6). The density of the reflected infrared energy rays 72 decrease as the rays 68 are scattered by the outermost sheets 61 and sensed interfaces between adjacent sheets.

With reference to FIG. 6, number 250 which corresponds to a nominal glass thickness of 0.250 inch (0.635 centimeters) is set on the dial 126 connected to the microprocessor 92 by cable 128. The microprocessor 92 selects a working pulse range of 362–502 pulses from Equation 1 and 2 and 31 pulse values within the range as was previously discussed. The pulse values are listed in Table VIII. The plate counter 20 is set at the edge of the stack 34 and button 130 depressed to initiate the microprocessor 92 to receive the signal 85 from the comparator 84. The plate counter 20 is moved over the sides 24 of the stacked sheets 26 as shown in FIG. 1. With reference to FIG. 6, signal 78 of the detector 70 is forwarded to amplifier and inverter circuit 80 and signal 114 of the encoder 52 is forwarded by cable 28 to frequency doubler circuit 116. The signal 114 from the encoder has 890 pulses for each inch of plate counter travel, and the signal 118 has 1,780 pulses for each inch of plate counter travel. The signal 118 is forwarded to pulse counter 122 by cable 120.

The signal 78 from the detector 70 shows increasing density of reflected energy rays 72 as the plate counter 20 moves over the first outermost sheet 61; slight variations in density as the plate counter moves over sides 24 of the sheets 26; significant decrease in density followed by an increasing density as the plate counter moves over sensed interfaces between adjacent sheets; and a significant decrease in density as the counter moves over the last outermost sheet 61. The signal 78 is amplified and inverted by the amplifier and inverter circuit 80. Signal 82 from the amplifier and inverter 80 is forwarded by cable 86 to comparator 84 and to differentiator 88 by cable 90. The comparator 84 is set to square peaks having a density of about 20% greater than the infrared energy sensed by the detector exposed to the environment. The differentiated signal 94 from the differentiator 88 is forwarded to the comparator 98 by cable 96. The comparator 98 is set to square peaks of the signal 94 having a derivative slightly greater than the density derivative of the sensed sides of the sheets.

When the first trailing edge of the signal 85 from the comparator 84 is received by the microprocessor 92, (1) the pulse counter 122 is reset to zero and begins to count pulses of the signal 118; (2) the remaining portions of the signal 85 are disregarded; (3) the signal 100 of the comparator 98 is forwarded by cable 102 to the microprocessor 92; (4) software timer 135 which is set to time out after one second is reset to zero; and (5) sheet counter 137 is reset to zero. When the leading edge of the first squared peak of the signal 100 is received, (1) the timer 135 is reset to zero; (2) the pulse counts in the pulse counter 122 are forwarded by cable 124 to the microprocessor 92 and stored therein as first measured sheet pulse count; and (3) the pulse counter 122 is reset to zero by cable 134. When the trailing edge of a first squared peak of the signal 100 is sensed by the microprocessor 92, (1) the timer 135 is reset to zero; (2) the pulse counts in the pulse counter 122 are forwarded to the microprocessor 92 and stored therein as first measured interface pulse count; and (3) the plate counter is reset to zero. When the leading edge of the second squared peak of the signal 100 is sensed, (1) the timer 137 is reset to zero; (2) the pulse counts in the pulse counter 122 are forwarded to the microprocessor 92 and stored therein as second measured sheet pulse count; and (3) the pulse counter is reset to zero. When the trailing edge of the second squared peak of the signal 100 is sensed, (1) the timer 137 is reset to zero; (2) the pulse counts in the pulse counter 122 are forwarded and stored in the microprocessor 92 as second measured interface pulse count; and (3) the plate counter is reset to zero. The above is repeated to determine the remaining measured sheet pulse counts and measured interface pulse counts. After the leading edge of the last squared peak which corresponds to the edge of the last outermost sheet is sensed by the microprocessor 92, (1) the timer 137 times out because there are no further peak edges and the pulse count in the pulse counter 122 is disregarded and the collected data is acted on.

Calculated sheet pulse counts are determined from the measured sheet pulse counts and measured interface pulse counts. First calculated sheet pulse count is determined by adding the first measured sheet pulse count to one-half the first measured interface pulse count, the second calculated sheet pulse count is determined by adding the second measured sheet pulse count to one-half the first and one-half the second measured interface pulse counts and so forth. The last calculated sheet pulse count is the last measured sheet pulse count plus one-half the last measured interface pulse count. The calculated sheet pulse counts for the ten (10) scanned sheets are shown in Table I.

TABLE I

| Calculated Sheet Pulse Counts | |
|---|---|
| First Calculated Sheet Pulse Count | 496 |
| Second Calculated Sheet Pulse Count | 348 |
| Third Calculated Sheet Pulse Count | 403 |
| Fourth Calculated Sheet Pulse Count | 395 |
| Fifth Calculated Sheet Pulse Count | 430 |
| Sixth Calculated Sheet Pulse Count | 53 |

TABLE I-continued

| Calculated Sheet Pulse Counts | |
|---|---|
| Seventh Calculated Sheet Pulse Count | 47 |
| Eighth Calculated Sheet Pulse Count | 295 |
| Ninth Calculated Sheet Pulse Count | 438 |
| Tenth Calculated Sheet Pulse Count | 773 |
| Eleventh Calculated Sheet Pulse Count | 437 |

The pair of sheet counts for the pulse values of 362; 432; and 502 are determined as shown in Tables II and III; Table IV and V; Table VI and VII, respectively. Pair of sheet counts for the remaining pulse values are calculated in a similar manner using Sections I; II; III; or IV, and the pair of sheet counts for the pulse value are shown in Table VIII.

From Table VIII, there are 21 consecutive pairs of 10 sheet counts which is greater than the required 10 consecutive pair of sheet counts. Therefore, there are 10 sheets in the stack. The instant invention was used to count 110 racks of stacked glass sheets of different nominal glass thickness after which each stack was manually counted. The accuracy of the instant invention is shown in Table IV.

As can now be appreciated, the above examples are presented for illustration purposes and are not limiting to the invention.

TABLE II

Determination of Sheet Count for Pulse Value of 362
Performed with Calculated Sheet Pulse Counts 1 through 11

| Steps | COLUMN I Calculated Sheet Pulse Count (Note 1) | COLUMN II Tentative Adjusted Sheet Pulse Count (Note 2) | COLUMN III Adjusted Sheet Pulse Count (Note 3) | COLUMN IV Tentative Adjusted Pulse Value (Note 4) | COLUMN V Adjusted Pulse Value (Note 5) | COLUMN VI Tentative Sheet Pulse Difference (Note 6) | COLUMN VII Sheet Pulse Difference (Note 7) | COLUMN VIII Sheet Adjustment Factor (Note 8) | COLUMN IX Modified Pulse Value (Note 9) | COLUMN X Sheet Count Add | COLUMN X Sheet Count Cumulative | COLUMN XI Applicable Section |
|---|---|---|---|---|---|---|---|---|---|---|---|---|
| 1 | 496 | 496 | | 362 | | 134 | | | | 1 | 1 | I |
| 2 | | | 496 | | 362 | | 134 | 16.750 | 378.750 | | | II |
| 3 | 348 | 844 | | 740.750 | | 103.250 | | | | 1 | 2 | II |
| 4 | | | 844 | | 740.750 | | 103.250 | 25.375 | 387.375 | | | II |
| 5 | 403 | 1247 | | 1128.125 | | 118.875 | | | | 1 | 3 | II |
| 6 | | | 1247 | | 1128.125 | | 118.875 | 33.875 | 355.875 | | | II |
| 7 | 395 | 1642 | | 1524 | | 118.000 | | | | 1 | 4 | II |
| 8 | | | 1642 | | 1524 | | 118 | 40.125 | 402.125 | | | II |
| 9 | 430 | 2072 | | 1926.125 | | 145.875 | | | | 1 | 5 | II |
| 10 | | | 2072 | | 1926.125 | | 145.875 | 48.250 | 410.250 | | | II |
| 11 | 53 | 2125 | | 2336.375 | | −211.375 | | | | 1 | 6 | II |
| 12 | 47 | 2172 | | 2336.375 | | −164.375 | | | | | | III |
| 13 | | | 2172 | | 2336.375 | | −164.375 | 15.625 | 377.625 | | | II |
| 14 | 295 | 2467 | | 2714 | | −247 | | | | 1 | 7 | II |
| 15 | 438 | 2905 | | 2714 | | 191 | | | | | | III |
| 16 | | 2905 | | 3091.625 | | −186.625 | | | | 1 | 8 | Part II IV |
| 17 | 773 | 3678 | | 3091.625 | | 586.375 | | | | | | III |
| 18 | | 3678 | | 3469.250 | | 208.750 | | | | 1 | 9 | Part II IV |
| 19 | | 3678 | | 3846.875 | | −168.875 | | | | 1 | 10 | Part II IV |
| 20 | | | 3678 | | 3846.875 | | −168.875 | −9.375 | 352.625 | | | II |
| 21 | 437 | 4115 | | 4199.500 | | −84.500 | | | | 1 | 11 | II |

TABLE III

Determination of Sheet Count for Pulse Value of 362
Performed with Calculated Sheet Pulse Counts 11 through 1

| Steps | COLUMN I Calculated Sheet Pulse Count (Note 1) | COLUMN II Tentative Adjusted Sheet Pulse Count (Note 2) | COLUMN III Adjusted Sheet Pulse Count (Note 3) | COLUMN IV Tentative Adjusted Pulse Value Note 4) | COLUMN V Adjusted Pulse Value (Note 5) | COLUMN VI Tentative Sheet Pulse Difference (Note 6) | COLUMN VII Sheet Pulse Difference (Note 7) | COLUMN III Sheet Adjustment Factor (Note 8) | COLUMN IX Modified Pulse Value (Note 9) | COLUMN X Sheet Count Add | COLUMN X Sheet Count Cumulative | COLUMN XI Applicable Section |
|---|---|---|---|---|---|---|---|---|---|---|---|---|
| 1 | 437 | 437 | | 362 | | 75 | | | | 1 | 1 | I |
| 2 | | | 437 | | 362 | | 75 | 9.375 | 371.375 | | | II |
| 3 | 773 | 1210 | | 733.375 | | 476.625 | | | | 1 | 2 | II |
| 4 | | 1210 | | 1104.750 | | 105.250 | | | | 1 | 3 | Part II IV |
| 5 | | | 1210 | | 1104.750 | | 105.250 | 20.125 | 382.125 | | | II |
| 6 | 438 | 1648 | | 1486.875 | | 161.125 | | | | 1 | 4 | II |
| 7 | | | 1648 | | 1486.875 | | 161.125 | 35.125 | 397.125 | | | II |
| 8 | 295 | 1943 | | 1884 | | 59 | | | | 1 | 5 | II |
| 9 | | | 1943 | | 1884 | | 59 | 33.625 | 395.625 | | | II |
| 10 | 47 | 1990 | | 2279.625 | | −289.625 | | | | 1 | 6 | II |
| 11 | 53 | 2043 | | 2279.625 | | −236.625 | | | | | | III |
| 12 | 430 | 2473 | | 2279.625 | | 193.375 | | | | | | III |
| 13 | | 2473 | | 2675.250 | | −202.250 | | | | 1 | 7 | Part II IV |
| 14 | 395 | 2868 | | 2675.250 | | 192.750 | | | | | | III |
| 15 | | 2868 | | 3070.872 | | −202.875 | | | | 1 | 8 | Part II IV |
| 16 | 403 | 3271 | | 3070.872 | | 200.125 | | | | | | III |
| 17 | | 3271 | | 3466.5 | | −195.5 | | | | 1 | 9 | Part II IV |
| 18 | 348 | 3619 | | 3466.5 | | 152.5 | | | | | | II |
| 19 | | | 3619 | | 3466.5 | | 152.5 | 44.25 | 406.25 | | | II |
| 20 | 496 | 4115 | | 3872.750 | | 242.25 | | | | 1 | 10 | II |
| 21 | | 4115 | | 4279.000 | | −164.000 | | | | 1 | 11 | Part II IV |

TABLE IV

Determination of Sheet Count for Pulse Value of 432
Performed with Calculated Sheet Pulse Counts 1 through 11

| Steps | COLUMN I Calculated Sheet Pulse Count (Note 1) | COLUMN II Tentative Adjusted Sheet Pulse Count (Note 2) | COLUMN III Adjusted Sheet Pulse Count (Note 3) | COLUMN IV Tentative Adjusted Pulse Value (Note 4) | COLUMN V Adjusted Pulse Value (Note 5) | COLUMN VI Tentative Sheet Pulse Difference (Note 6) | COLUMN VII Sheet Pulse Difference (Note 7) | COLUMN VIII Sheet Adjustment Factor (Note 8) | COLUMN IX Modified Pulse Value (Note 9) | COLUMN X Sheet Count Add | COLUMN X Sheet Count Cumulative | COLUMN XI Applicable Section |
|---|---|---|---|---|---|---|---|---|---|---|---|---|
| 1 | 496 | 496 | | 432 | | 64 | | | | 1 | 1 | I |
| 2 | | | 496 | | 432 | | 64 | 8 | 440 | | | II |
| 3 | 348 | 844 | | 872 | | −28 | | | | 1 | 2 | II |
| 4 | | | 844 | | 872 | | −28 | 2.5 | 434.5 | | | II |
| 5 | 403 | 1247 | | 1306.5 | | −59.5 | | | | 1 | 3 | II |
| 6 | | | 1247 | | 1306.5 | | −59.5 | −5.5 | 426.5 | | | II |
| 7 | 395 | 1642 | | 1733 | | −91 | | | | 1 | 4 | II |
| 8 | | | 1642 | | 1733 | | −91 | −15.5 | 416.5 | | | II |
| 9 | 430 | 2072 | | 2149.5 | | −77.5 | | | | 1 | 5 | II |
| 10 | | | 2072 | | 2149.5 | | −77.5 | −21.25 | 410.75 | | | II |
| 11 | 53 | 2125 | | 2560.25 | | −435.25 | | | | 1 | 6 | II |
| 12 | 47 | 2172 | | 2560.25 | | −388.25 | | | | | | III |
| 13 | 295 | 2467 | | 2560.25 | | −93.25 | | | | | | III |
| 14 | | | 2467 | | 2560.25 | | −93.25 | −27.5 | 404.5 | | | II |
| 15 | 438 | 2905 | | 2964.75 | | −59.75 | | | | 1 | 7 | II |
| 16 | | | 2905 | | 2964.75 | | −59.75 | −28 | 404 | | | II |
| 17 | 773 | 3678 | | 3368.75 | | 309.25 | | | | 1 | 8 | II |
| 18 | | 3678 | | 3772.75 | | −94.75 | | | | 1 | 9 | Part II IV |
| 19 | | | 3678 | | 3772.75 | | −94.75 | −32.75 | 399.25 | | | II |
| 20 | 437 | 4115 | | 4172 | | −57 | | | | 1 | 10 | II |

TABLE V

Determination of Sheet Count for Pulse Value of 432
Performed with Calculated Sheet Pulse Counts 11 through 1

| Steps | COLUMN I Calculated Sheet Pulse Count (Note 1) | COLUMN II Tentative Adjusted Sheet Pulse Count (Note 2) | COLUMN III Adjusted Sheet Pulse Count (Note 3) | COLUMN IV Tentative Adjusted Pulse Value (Note 4) | COLUMN V Adjusted Pulse Value (Note 5) | COLUMN VI Tentative Sheet Pulse Difference (Note 6) | COLUMN VII Sheet Pulse Difference (Note 7) | COLUMN VIII Sheet Adjustment Factor (Note 8) | COLUMN IX Modified Pulse Value (Note 9) | COLUMN X Sheet Count Add | COLUMN X Sheet Count Cumulative | COLUMN XI Applicable Section |
|---|---|---|---|---|---|---|---|---|---|---|---|---|
| 1 | 437 | 437 | | 432 | | 5 | | | | 1 | 1 | I |
| 2 | | | 437 | | 432 | | 5 | 0.625 | 432.615 | | | II |
| 3 | 773 | 1210 | | 864.625 | | 345.375 | | | | 1 | 2 | II |
| 4 | | 1210 | | 1297.250 | | −87.25 | | | | 1 | 3 | Part II IV |
| 5 | | | 1210 | | 1297.250 | | −87.25 | −10.375 | 421.625 | | | II |
| 6 | 438 | 1648 | | 1718.875 | | −70.875 | | | | 1 | 4 | II |
| 7 | | | 1648 | | 1718.875 | | −70.875 | −16.625 | 415.375 | | | II |
| 8 | 295 | 1943 | | 2134.25 | | −191.25 | | | | 1 | 5 | II |
| 9 | | | 1943 | | 2134.25 | | −191.25 | −36.375 | 395.625 | | | II |
| 10 | 47 | 1990 | | 2529.875 | | −539.875 | | | | 1 | 6 | II |
| 11 | 53 | 2043 | | 2529.875 | | −486.875 | | | | | | III |
| 12 | 430 | 2473 | | 2529.875 | | −56.875 | | | | | | III |
| 13 | | | 2473 | | 2529.875 | | −56.875 | −34.375 | 397.625 | | | II |
| 14 | 395 | 2868 | | 2927.500 | | −59.5 | | | | 1 | 7 | II |
| 15 | | | 2868 | | 2927.500 | | −59.5 | −33.125 | 398.875 | | | II |
| 16 | 403 | 3271 | | 3326.375 | | −55.375 | | | | 1 | 8 | II |
| 17 | | | 3271 | | 3326.375 | | −55.375 | −31.750 | 400.25 | | | II |
| 18 | 348 | 3619 | | 3726.625 | | −107.625 | | | | 1 | 9 | II |
| 19 | | | 3619 | | 3726.625 | | −107.625 | −37.25 | 394.75 | | | II |
| 20 | 496 | 4115 | | 4121.375 | | −6.375 | | | | 1 | 10 | II |

TABLE VI

Determination of Sheet Count for Pulse Value of 502
Performed with Calculated Sheet Pulse Counts 1 through 11

| Steps | COLUMN I Calculated Sheet Pulse Count (Note 1) | COLUMN II Tentative Adjusted Sheet Pulse Count (Note 2) | COLUMN III Adjusted Sheet Pulse Count (Note 3) | COLUMN IV Tentative Adjusted Pulse Value (Note 4) | COLUMN V Adjusted Pulse Value (Note 5) | COLUMN VI Tentative Sheet Pulse Difference (Note 6) | COLUMN VII Sheet Pulse Difference (Note 7) | COLUMN VIII Sheet Adjustment Factor (Note 8) | COLUMN IX Modified Pulse Value (Note 9) | COLUMN X Sheet Count Add | COLUMN X Sheet Count Cumulative | COLUMN XI Applicable Section |
|---|---|---|---|---|---|---|---|---|---|---|---|---|
| 1 | 496 | 496 | | 502 | | −6 | | | | 1 | 1 | I |
| 2 | | | 496 | | 502 | | −6 | −.75 | 501.25 | | | II |
| 3 | 348 | 844 | | 1003.25 | | −159.25 | | | | 1 | 2 | II |
| 4 | | | 844 | | 1003.25 | | −159.25 | −20.375 | 481.625 | | | II |
| 5 | 403 | 1247 | | 1484.875 | | −237.875 | | | | 1 | 3 | II |
| 6 | | | 1247 | | 1484.875 | | −237.875 | −45 | 457 | | | II |
| 7 | 395 | 1642 | | 1941.875 | | −299.875 | | | | 1 | 4 | II |
| 8 | 430 | 2072 | | 1941.875 | | 130.125 | | | | | | III |
| 9 | | | 2072 | | 1941.875 | | 130.125 | −17.375 | 484.625 | | | II |
| 10 | 53 | 2125 | | 2426.500 | | −301.5 | | | | 1 | 5 | II |
| 11 | 47 | 2172 | | 2426.500 | | −254.5 | | | | | | III |
| 12 | 295 | 2467 | | 2426.500 | | 40.5 | | | | | | III |
| 13 | | | 2467 | | 2426.500 | | 40.5 | −7.875 | 494.125 | | | II |
| 14 | 438 | 2905 | | 2920.625 | | −15.625 | | | | 1 | 6 | II |
| 15 | | | 2905 | | 2920.625 | | −15.625 | −7.75 | 494.25 | | | II |
| 16 | 773 | 3678 | | 3414.875 | | 263.125 | | | | 1 | 7 | II |
| 17 | | 3678 | | 3909.125 | | −231.125 | | | | 1 | 8 | Part II IV |
| 18 | | | 3678 | | 3909.125 | | −231.125 | −34.625 | 467.375 | | | II |
| 19 | 437 | 4115 | | 4376.5 | | −261.5 | | | | 1 | 9 | II |
| 20 | | | | 4376.5 | | | | | | −1 | 8 | III |

TABLE VII

Determination of Sheet Count for Pulse Values of 502
Performed with Calculated Sheet Pulse Counts 11 through 1

| Steps | COLUMN I Calculated Sheet Pulse Count (Note 1) | COLUMN II Tentative Adjusted Sheet Pulse Count (Note 2) | COLUMN III Adjusted Sheet Pulse Count (Note 3) | COLUMN IV Tentative Adjusted Pulse Value (Note 4) | COLUMN V Adjusted Pulse Value (Note 5) | COLUMN VI Tentative Sheet Pulse Difference (Note 6) | COLUMN VII Sheet Pulse Difference (Note 7) | COLUMN VIII Sheet Adjustment Factor (Note 8) | COLUMN IX Modified Pulse Value (Note 9) | COLUMN X Sheet Count Add | COLUMN X Sheet Count Cumulative | COLUMN XI Applicable Section |
|---|---|---|---|---|---|---|---|---|---|---|---|---|
| 1 | 437 | 437 | | 502 | | −65 | | | | 1 | 1 | I |
| 2 | | | 437 | | 502 | | −65 | −8.125 | 493.875 | | | II |
| 3 | 773 | 1210 | | 995.875 | | 214.125 | | | | 1 | 2 | II |
| 4 | | | 1210 | | 995.875 | | 214.125 | 20.625 | 522.625 | | | II |
| 5 | 438 | 1648 | | 1518.500 | | 129.500 | | | | 1 | 3 | II |
| 6 | | | 1648 | | 1518.500 | | 129.500 | 31.625 | 533.625 | | | II |
| 7 | 295 | 1943 | | 2052.125 | | −109.125 | | | | 1 | 4 | II |
| 8 | | | 1943 | | 2052.125 | | −109.125 | 10 | 512 | | | II |
| 9 | 47 | 1990 | | 2564.125 | | −574.125 | | | | 1 | 5 | II |
| 10 | 53 | 2043 | | 2564.125 | | −521.125 | | | | | | III |
| 11 | 430 | 2473 | | 2564.125 | | −91.125 | | | | | | III |
| 12 | | | 2473 | | 2564.125 | | −91.125 | −3.875 | 495.125 | | | II |
| 13 | 395 | 2868 | | 3062.250 | | −194.25 | | | | 1 | 6 | II |
| 14 | | | 2868 | | 3062.250 | | −194.250 | −27.125 | 474.875 | | | II |
| 15 | 403 | 3271 | | 3537.125 | | −266.125 | | | | 1 | 7 | II |
| 16 | 348 | 3619 | | 3537.125 | | 81.875 | | | | | | III |
| 17 | | | 3619 | | 3537.125 | | 81.875 | −10 | 492 | | | II |
| 18 | 496 | 4115 | | 4029.125 | | 85.875 | | | | 1 | 8 | II |

NOTE 1:
In Tables II, IV and VI, the calculated sheet pulse counts are the first through the eleventh as shown in Table I. In Tables III, V and VII, the calculated sheet pulse counts are the eleventh through the first as shown in Table I.

NOTE 2:
The tentative adjusted sheet pulse count (Column II) for Step 1 is determined by adding zero to the calculated sheet pulse count (Column 1) in accordance to Section I. When the absolute value of the tentative sheet pulse difference (Column VI) is less than one-half the pulse value, the tentative adjusted sheet pulse count (Column II) for the applicable remaining steps are determined by adding the adjusted sheet pulse count (Column III) to the next available calculated sheet pulse count (Column I) in accordance to Section II. When the tentative sheet pulse difference (Column VI) is negative and the absolute value greater that one-half the pulse value, the tentative adjusted sheet pulse count (Column II) for the applicable remaining steps is added to the next available calculated sheet pulse count to determine a new tentative, adjusted sheet pulse count in accordance to Section III. When the tentative sheet pulse difference (Column VI) is positive and the absolute value greater than one-half the pulse value, the tentative adjusted sheet pulse counts (Column II) for the applicable remaining steps are unchanged in accordance to Part II. Section IV.

NOTE 3:
The adjusted sheet pulse count (Column III) is the preceding tentative adjusted sheet pulse count (Column II) when the absolute value of the tentative sheet pulse difference (Column VI) is less than one-half the pulse value in accordance to Section II.

NOTE 4:
The tentative adjusted pulse value for Step 1 is determined by adding the pulse value to zero in accordance to Section I. When the absolute value of the tentative sheet pulse difference (Column VI) is less than one-half the pulse value, the tentative adjusted pulse value (Column IV) for the applicable remaining steps is determined by adding the adjusted pulse value (Column V) to the modified pulse value (Column IX) in accordance to Section II. When the tentative sheet pulse difference(Column VI) is negative and the absolute value greater than one-half the pulse value (Column VI), the tentative adjustable pulse value (Column IV) for the applicable remaining steps is the preceding tentative adjusted pulse value (Column IV) in accordance to Section III. When the tentative sheet pulse difference (Column VI) is positive and the absolute value greater than one-half the pulse value (Column VI), the tentative adjusted pulse value (Column IV) for the applicable remaining steps is the preceding tentative adjusted pulse value (Column IV) added to the preceding modified pulse value (Column IX) in accordance to Part II, Section IV.

NOTE 5:
The adjusted pulse value (Column V) is the preceding tentative adjusted pulse value (Column IV) when the absolute value of the tentative sheet pulse difference (Column VI) is less than one-half the pulse value in accordance to Section II.

NOTE 6:
The tentative sheet pulse difference (Column VI) is determined by subtracting the tentative adjusted pulse value (Column IV) from the tentative adjusted sheet pulse count (Column II) in accordance to Sections I, II, III or IV.

NOTE 7:
The sheet pulse difference (Column VII) is the preceding tentative sheet pulse difference (Column VI) when the absolute value of the tentative sheet pulse difference (Column VI) is less than one-half the pulse value in accordance to Section II.

NOTE 8:
The sheet adjustment factor (Column VIII) is determined from Equation 3 where $D_x$ is the applicable sheet pulse difference (Column VII) in accordance to Section II.

NOTE 9:
The modified pulse value (Column IX) is the pulse value added to the applicable sheet adjustment factor (Column VIII) in accordance to Section II.

TABLE VIII

| Pulse Values in Working Pulse Range and Calculated Pair of Sheet Counts | | |
|---|---|---|
| Pulse Values in Working Pulse Range | Sheet Count for Calculated Sheet Pulse Counts 1 through 11 from Table I | Sheet Count for Calculated Sheet Pulse Counts 11 through 1 from Table I |
| 362 | 11 (from Table II) | 11 (from Table III) |
| 367 | 10 | 10 |
| 371 | 10 | 10 |
| 376 | 10 | 10 |
| 381 | 10 | 10 |
| 385 | 10 | 10 |
| 390 | 10 | 10 |
| 395 | 10 | 10 |
| 399 | 10 | 10 |
| 404 | 10 | 10 |
| 409 | 10 | 10 |
| 413 | 10 | 10 |
| 418 | 10 | 10 |
| 423 | 10 | 10 |
| 427 | 10 | 10 |
| 432 | 10 (from Table IV) | 10 (from Table V) |
| 437 | 10 | 10 |
| 441 | 10 | 10 |
| 446 | 10 | 10 |
| 451 | 10 | 10 |
| 455 | 10 | 10 |
| 460 | 10 | 10 |
| 465 | 9 | 10 |
| 469 | 9 | 10 |
| 474 | 9 | 9 |
| 479 | 9 | 9 |
| 483 | 9 | 9 |
| 488 | 9 | 8 |
| 493 | 9 | 8 |
| 497 | 9 | 8 |
| 502 | 8 (from Table VI) | 8 (from Table VII) |

TABLE IX

| Accuracy of Instant Invention | | | | | | |
|---|---|---|---|---|---|---|
| Nominal Glass thickness | Total Packs of Stacked Sheets Scanned | Sheet Count Error [Sheet Count Determined In Accordance to the Instant Invention - Manual Sheet Count] −3 | −2 | −1 | 0 | 1 2 3 |
| 0.090 inch (2.30 mm) | 2 | | | | 2 | |
| 3/32 inch (2.38 mm) | 39 | | | 3 | 32 | 4 |
| 0.100 inch (2.50 mm) | 10 | | | | 10 | |
| 0.115 inch (2.92 mm) | 11 | | | 1 | 10 | |
| ⅛ inch (3.18 mm) | 13 | | | | 13 | |
| 5/32 inch (3.97 mm) | 4 | | | | 1 | 1 1 1 |
| 3/16 inch (4.76 mm) | 29 | | | | 26 | 3 |
| ¼ inch (6.35 mm) | 2 | | | | 2 | |
| | | — | — | 4 | 96 | 8 1 1 |

What is claimed is:

1. An apparatus for determining number of sheets in a stack, each sheet having an energy reflective side and stacked to provide the stack with an energy reflective side, comprising:

means for directing energy rays toward the reflective side of the stack to reflect energy rays therefrom;

means for generating a reflective energy density signal from the reflective energy rays as a function of pulse counts corresponding to position energy rays are reflected from the reflective side of the stack;

means for measuring nominal thickness of the sheets to be stacked;

means for determining (1) calculated sheet pulse counts from the density signal and pulse counts; (2) a working pulse range from the nominal thickness; and (3) a plurality of pulse values within the working pulse range;

means acting on the calculated sheet pulse counts and pulse values for determining a pair of sheet counts for each pulse value;

means for energizing said generating, measuring and determining means for initial determination of pair of sheet counts for each pulse value and subsequent determination of pair of sheet counts for each pulse value when the number of consecutive pairs of equal sheet counts is less than a predetermined number; and means acted on by said energizing means when the number of consecutive pairs of equal pair of equal sheet counts is more than the predetermined number to provide acceptable pair of sheet counts for recording sheet count which is the sheet count of one of the pair of sheet counts included in the acceptable pair of sheet counts.

2. The apparatus as set forth in claim 1 wherein said determining means includes:

means for determining (1) a tentative adjusted sheet pulse count; (2) a tentative adjusted pulse value; and (3) subtracting the tentative adjusted pulse value from the tentative adjusted sheet pulse count to determine a tentative sheet pulse difference.

3. The apparatus as set forth in claim 2 wherein the pulse value under consideration is defined as pulse value acted on and said determining means further includes;

means for converting (1) the tentative adjusted sheet pulse count to an adjusted sheet pulse count; (2) the tentative adjusted pulse value to an adjusted pulse value; and (3) the tentative adjusted sheet pulse difference to a sheet pulse difference when the absolute value of the tentative sheet pulse difference is less than about one-half of the pulse value acted on; and means for calculating (1) a new tentative adjusted sheet pulse count when the tentative sheet pulse difference is negative and the absolute value of the tentative sheet pulse different is greater than about one-half the selected pulse value; and (2) a new tentative adjusted pulse value when the tentative sheet pulse difference is positive and the absolute value of the tentative sheet pulse difference is greater than about one-half the selected pulse value acted on.

4. The apparatus as set forth in claim 3 wherein said determining means further includes:

a sheet counter;

means acting on said calculating means and acting on said sheet counter for adding a one to said sheet counter each time a tentative adjusted pulse value is determined and for subtracting a one from said sheet counter when (1) the tentative sheet pulse difference is negative; (2) the absolute value of the tentative sheet pulse difference is greater than about one-half the selected pulse value; and (3) there are no remaining calculated sheet pulse counts.

5. The apparatus as set forth in claim 4 wherein said determining means calculates a sheet count for each pulse value in sequential order that the calculated sheet counts were determined and thereafter in a sequential order opposite to the previous sequential order.

6. The apparatus as set forth in claim 1 or 5 wherein the sheets are glass sheets.

7. A method of determining number of sheets in a stack, each sheet having an energy reflective side, comprising the steps of:

stacking the sheets with the energy reflective side of the sheets forming one side of the stack;

directing energy rays toward the energy relective side of the stack to reflect energy rays therefrom;

scanning the reflected energy rays to generate a reflected energy density signal and a dimensional signal each as a function of the position the energy rays are reflected from the energy reflective side of the stack;

operating on the reflected energy density signal at a predetermined density level to indicate each apparent interface between adjacent sheets and each apparent side of the sheet between apparent adjacent interfaces;

operating on the dimensional signal to provide measured interface counts for each of the apparent interfaces and to provide measured sheet counts for each apparent side of a sheet; and acting on the measured sheet counts and measured interface counts to determine the number of sheets in the stack.

8. The method as set forth in claim 7 wherein said step of operating on the reflected energy density signal is accomplished by:

squaring peaks of the reflected energy density signal at the predetermined density level to indicate the apparent adjacent interfaces between apparent adjacent sheets; and said acting step includes combining a measured sheet count and a portion of a measured interface count for at least one of the adjacent squared peaks to provide calculated sheet counts.

9. A method of determining number of sheets in a stack, each sheet having an energy reflective side, comprising the steps of:

stacking the sheets with the energy reflective side of the sheets forming one side of the stack;

scanning the energy reflective side of the stack to generate a reflected energy density signal as a function of position on the side of the stack, said scanning step including the step of:

generating a dimensional signal corresponding to position on the energy reflective side of the stack;

filtering the reflected energy density signal to reduce component of the reflected energy density signal due to nonalignment of the reflective side of the sheets to provide a modified energy density signal; and operating on the modified energy density signal to determine the number of sheets in the stack said operating step including the steps of:

squaring the peaks of the modified reflected energy density signal at a predetermined density level to indicate each apparent interface between adjacent sheets;

providing from the dimensional signal and the squared modified reflected energy signal a measured interface count for each apparent interface between adjacent sheets and a measured sheet count for each apparent side of a sheet between adjacent apparent interfaces; and combining a measured sheet count and a portion of the measured interface count for at least one of the adjacent squared peaks to provide calculated sheet counts.

10. The method as set forth in claim 7 or 9 wherein the calculated sheet counts are calculated sheet pulse counts and further including the steps of:

determining nominal thickness of the sheets;

calculating a plurality of pulse values within a predetermined working pulse range; and acting on the calculated sheet pulse counts and each of the pulse values to determine a pair of sheet counts for each pulse value.

11. The method as set forth in claim 1 wherein a pulse count under consideration is a pulse value acted on and said step of acting on the calculated sheet pulse counts and each of the pulse values includes the steps of:

a. determining a tentative adjusted sheet pulse count;

b. determining a tentative adjusted pulse value;

c. subtracting the tentative adjusted pulse value from the tentative adjusted sheet pulse count to determine a tentative sheet pulse difference;

d. determining a new tentative adjusted sheet pulse count when the tentative sheet pulse difference is negative and the absolute value of the tentative sheet pulse difference of said step c is greater than about one-half the pulse value acted on;

e. determining a new tentative adjusted pulse value when the tentative sheet pulse difference to said step c is positive and the absolute value of the tentative sheet pulse difference is greater than about one-half the pulse value acted on; and f. changing the tentative adjusted sheet pulse count to the adjusted sheet pulse count; the tentative adjusted pulse value to the adjusted pulse value; and the tentative adjusted sheet pulse difference to the sheet pulse difference when the absolute value of the tentative sheet pulse difference of said step c is less than about one-half the pulse value acted on.

12. The method as set forth in claim 11 wherein said step (d) of claim 2 is performed by:

adding the previous tentative adjusted sheet pulse count to the next available sheet pulse count;

said step (e) of claim 2 is performed by:

adding the previous tentative adjusted pulse value to previously determined modified pulse value;

said step (f) of claim 2 further includes:

determining a new tentative adjusted sheet pulse count by adding the previous adjusted sheet pulse count to the next available calculated sheet pulse count and determining a new tentative adjusted pulse value by adding the adjusted pulse value to recently determined modified pulse value; and further including the steps of:

adding one to a sheet count each time a tentative adjusted pulse value is determined; and subtracting one from the sheet count when (1) said step (d) of claim 2 is performed and (2) there are no remaining calculated sheet pulse counts.

13. The method as set forth in claim 12 wherein the modified pulse value is determined by adding the selected pulse value to a sheet adjustment factor determined from:

$$M_x = \frac{D_x - 6M_{x-1}}{8}$$

where $M_x$ is the sheet adjustment factor;

$D_x$ is the previous sheet pulse difference; and $M_{x-1}$ is the previous sheet adjustment factor where $M_o=0$.

14. The method as set forth in claim 1 wherein said step of acting on the calculated sheet pulse counts and each of the pulse values includes the steps of:

sequentially determining a sheet count for each of the calculated sheet pulse counts; and sequentially determining a sheet count for each of the calculated sheet pulse counts in the reverse order to that of the preceeding sequentially determining step.

15. The method as set forth in claim 14 wherein the sheets are glass sheets.

* * * * *

UNITED STATES PATENT AND TRADEMARK OFFICE

CERTIFICATE OF CORRECTION

PATENT NO. : 4,298,790

DATED : November 3, 1981

INVENTOR(S) : Forrest W. Decker et al.

It is certified that error appears in the above-identified patent and that said Letters Patent are hereby corrected as shown below:

Column 30, Claim 12, line 2, delete "2" and insert --11--.

Column 30, Claim 12, line 5, delete "2" and insert --11--.

Column 30, Claim 12, line 8, delete "2" and insert --11--.

Column 30, Claim 12, line 20, delete "2" and insert --11--.

Signed and Sealed this

*Second* Day of *February 1982*

[SEAL]

*Attest:*

GERALD J. MOSSINGHOFF

*Attesting Officer*

*Commissioner of Patents and Trademarks*